United States Patent [19]

Hodge

[11] 4,067,627

[45] Jan. 10, 1978

[54] PROTECTIVE COVER AND CLAMP FOR ETHER START UNIT

[75] Inventor: Norman J. Hodge, Peoria, Ill.

[73] Assignee: Caterpillar Tractor Co., Peoria, Ill.

[21] Appl. No.: 715,741

[22] Filed: Aug. 19, 1976

[51] Int. Cl.[2] ..... A47B 81/00; A47K 1/08

[52] U.S. Cl. ..... 312/100; 312/245; 248/311.1; 248/313

[58] Field of Search ..... 312/100, 245; 248/311.1, 313; 211/88, 75, 71

[56] References Cited

U.S. PATENT DOCUMENTS

| | | | |
|---|---|---|---|
| 1,302,125 | 4/1919 | Bechoff et al. | 248/311.1 |
| 1,624,830 | 4/1927 | Emsley | 248/311.1 |
| 1,929,562 | 10/1933 | Pierce | 248/311.1 |
| 2,445,930 | 7/1948 | Arens | 248/311.1 |
| 2,450,722 | 10/1948 | Drije | 248/311.1 |
| 2,656,948 | 10/1953 | McGee | 312/100 |
| 3,078,016 | 2/1963 | Judy | 312/245 |
| 3,337,172 | 8/1967 | Jackson | 312/245 |
| 3,365,535 | 1/1968 | Wilk | 312/100 |
| 3,765,635 | 10/1973 | Burrell et al. | 248/313 |

FOREIGN PATENT DOCUMENTS

| | | | |
|---|---|---|---|
| 1,249,403 | 8/1960 | France | 312/245 |

*Primary Examiner*—Paul R. Gilliam
*Assistant Examiner*—Victor N. Sakran
*Attorney, Agent, or Firm*—Phillips, Moore, Weissenberger, Lempio & Majestic

[57] ABSTRACT

The invention is concerned with the protective cover and clamping arrangement for a bottle. The arrangement comprises a first wall having hook means proceeding outwardly therefrom. The arrangement further comprises a can open along a first side and at a first end thereof, the first side thereof being fastenable against the first wall. Hook engaging means are provided proceeding outwardly from a second and closed end of the can for engagement with the hook means. A second wall proceeds generally outwardly from the first wall a spaced distance from the hook means generally equal to the length of the can. Fastening means are provided for fastening the first end of the can to the second wall to create a generally closed chamber about the bottle. Shape conforming first bottle engaging means are provided extending from the first wall to contact the bottle and shock absorbent second bottle engaging means are provided extending from the interior of the can to contact the bottle. More particularly, such an arrangement is disclosed for use with an ether start-up unit for an engine of a vehicle.

6 Claims, 3 Drawing Figures

PROTECTIVE COVER AND CLAMP FOR ETHER START UNIT

BACKGROUND OF THE INVENTION

1. Field of the Invention

The invention is concerned with providing a protective covering clamping arrangement for a bottle which contains a highly volatile and explosive fuel such as ether, which bottle is to be used to provide said highly volatile and explosive fuel during start-up of an engine of a vehicle. Because of the necessary location of the bottle adjacent to an engine, it is necessary to provide very complete safety protection for such a bottle. The present invention is concerned with a very safe and quick clamping arrangement for a bottle containing such a volatile and explosive fuel.

2. Prior Art

It is, of course, well known that ether is a very volatile and explosive fluid. It is further known that highly volatile fuels such as ether can advantageously be used on start-up of vehicle engines, especially during cold weather. The prior art has failed to provide a fully safe arrangement for quickly covering and clamping bottles of highly volatile fuel near an engine and in fact in an engine compartment, which arrangement can be easily opened to change bottles and if desired can be locked so as to protect against theft of the bottles, vandalism and the like. The present invention provides an arrangement which accomplishes all of these desirable results.

SUMMARY OF THE INVENTION

In one sense the invention comprises a protective cover and clamping arrangement for a bottle. The arrangement comprises a first wall having hook means proceeding outwardly therefrom. A can is provided which is open along a first side and at a first end thereof, said first side being fastenable against said first wall. Hook engaging means proceed outwardly from a second closed end of said can for engagement with the hook means. A second wall proceeds generally outwardly from the first wall at a spaced distance from the hook means generally equal to the length of the can. Fastening means are provided for fastening the first end of the can to the second wall to create a generally closed chamber about the bottle. Shape conforming first bottle engaging means are provided extending from the first wall to contact the bottle and shock absorbent second bottle engaging means are provided extending from the interior of the can to contact the bottle.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENT

Figure 1:
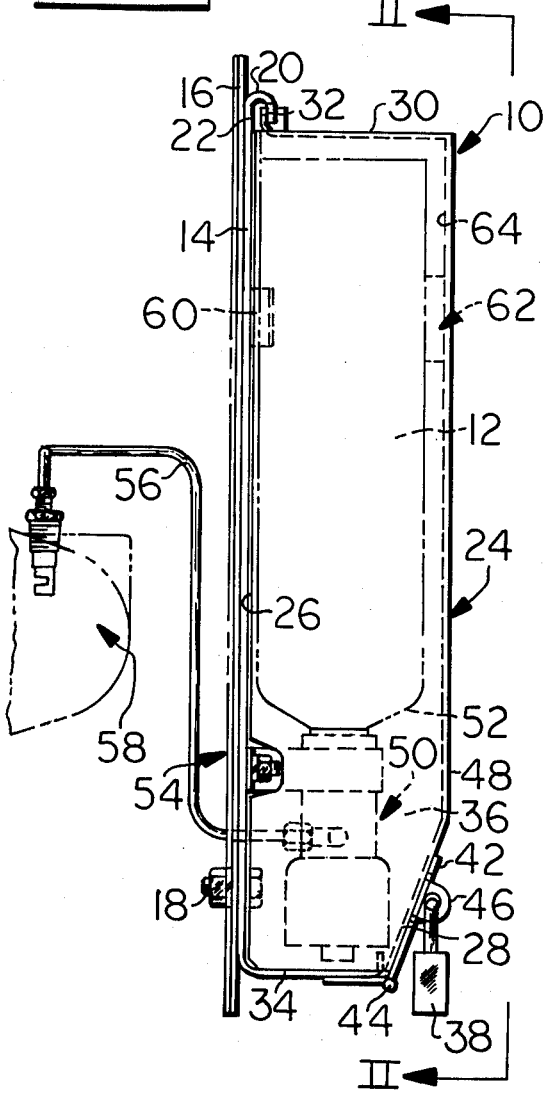
FIG. 1 illustrates an improved cover and clamping arrangement in accordance with the present invention in side elevation and schematically illustrates its use with an internal combustion engine.
Figure 2:
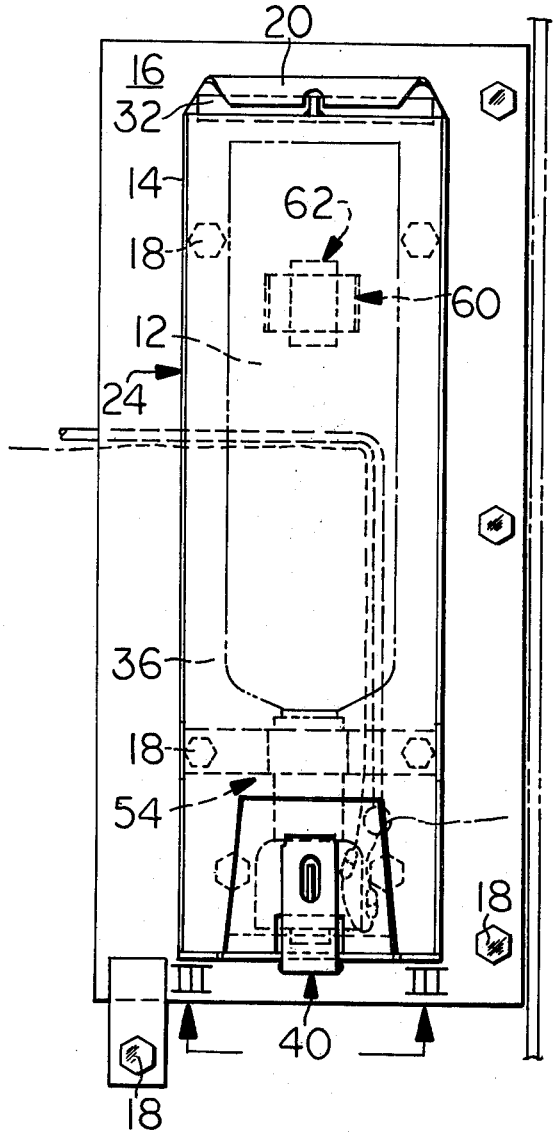
FIG. 2 comprises a view taken along the line II—II of FIG. 1.
Figure 3:
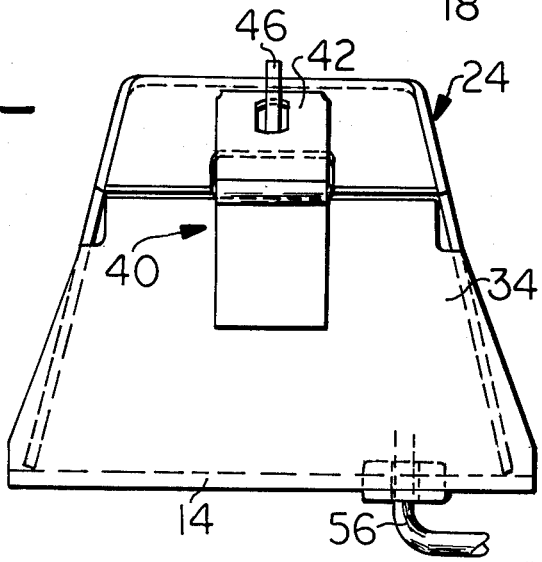
FIG. 3 illustrates a blown up view taken along the line III—III of FIG. 2.

Referring now most particularly to the figures of the drawing, there is illustrated therein a protective cover and clamping arrangement 10 in accordance with the present invention for the bottle 12. The arrangement includes a first wall 14 which will generally be fastened to a support member 16 with bolt and nut means 18 or the like. Hook means, in the embodiment illustrated, a U-shaped hook 20 formed by bending over a first end 22 of the first wall 14 proceeds outwardly from the first wall 14.

A can 24 is provided which is open along a first side 26 thereof and is also open adjacent a first end 28 thereof. The first side 26 of the can 24 is fastenable in abutting relation against the first wall 14 as is clear from FIG. 1 of the drawing. A second and closed end 30 of the can 24 includes hook engaging means, in the embodiment illustrated a plate 32 extending from the second end 30 of the can 24 with the plate 32 generally being formed unitarily with the second end 30 of the can 24 and proceeding outwardly therefrom into engagement with the U-shaped hook 20.

A second wall 34 proceeds generally outwardly from the first wall 14 and is generally integrally formed therewith, the second wall 34 being a spaced distance from the U-shaped hook 20, which spaced distance is generally equal to the length of the can 24 from the first end 28 thereof to the second end 30 thereof. The second wall 34 along with the first wall 14 and the can 24 fit abuttingly against one another to form a generally closed chamber 36 about the bottle 12. Fastening means, generally lock means such as a padlock 38 is illustrated in FIG. 1, serve to lock the first end 28 of the can 24 to the second wall 34. In the embodiment illustrated the locking means further includes a simple hasp 40 comprising a strap 42 hingably attached at 44 to the second wall 34 and a staple 46 extending outwardly from the can 24, and more particularly from a second side 48 thereof, which second side 48 is spaced away from the first side 26 thereof.

The support 16 for the first wall preferably comprises a fire wall of a vehicle and the bottle 12 generally includes therein a highly volatile fuel such as ether. Solenoid operated valve means 50 generally engage with the bottle 12 in a conventional manner, said valve means 50 extending from the fire wall 16 adjacent to the first end 28 of the can 24 and within the chamber 36. A fuel dispensing end 52 of the bottle 12 is supported generally by support means 54 which extend from the first wall 14 into contact with the valve means 50. The valve means 50 then receives fuel from the bottle 12 and controls outflow therefrom via a conduit 56 to an engine 58 of a vehicle or the like.

Shock absorbent first bottle engaging means, in the embodiment illustrated, a shape conforming pad arrangement 60, extends from the first wall 14 to contact the bottle 12. Second shock abosrbent bottle engaging means, in the embodiment illustrated a second absorbent pad arrangement 62, extends from an interior 64 of the second side 48 of the can 24 to contact the bottle 12. The second shock absorbent pad arrangement is generally formulated of a compressible material and often of an elastomeric material such as any of a number of natural and synthetic rubbers. The pad arrangements 60 and 62 are generally located opposite each other to provide even support for the bottle 12. Through use of the first shape conforming pad arrangement 60, the second absorbent pad arrangement 62 and the solenoid operated valve means 50, the bottle 12 is spaced within the chamber 36 so that firm support is afforded by the first wall 14 and the second wall 34, of the can 24. In this manner, the highly volatile and dangerous contents of the bottle 12 can very adequately be protected from shock. Further, because of the quick working padlock 38 and hasp 40, it is possible to quickly change bottles and to seal the bottle 12 within the chamber 36 whereby it cannot be easily removed by unauthorized persons.

While the invention has been described in connection with specific embodiments thereof, it will be understood that is is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A protective cover and clamping arrangement for a bottle, comprising:

a first wall;

hook means proceeding outwardly from said first wall adjacent a first end thereof;

a can open along a first side and at a first end thereof, said first side being fastenable against said first wall;

hook engaging means proceeding outwardly from a second closed end of said can for engagement with said hook means;

a second wall proceeding generally outwardly from said first wall a spaced distance from said hook means generally equal to the length of said can;

fastening means for fastening said first end of said can to said second wall to create a generally closed chamber about a bottle;

shape conforming first bottle engaging means extending from said first wall to contact said bottle; and shock-absorbent second bottle engaging means extending from the interior of said can to contact said bottle.

2. An arrangement as in claim 1, wherein said first wall, said second wall and said hook means are of unitary construction.

3. An arrangement as in claim 2, including a fire wall in a vehicle and means for attaching said first wall against said fire wall and wherein said bottle includes therein a volatile fuel and further including solenoid operated valve means extending from said can, a fuel dispensing end of said bottle being supported by support means extending from said first wall in contact with said valve means, said valve means receiving fuel from said bottle and controlling outflow therefrom.

4. An arrangement as in claim 3, wherein said fastening means comprises lock means locking said first end of said can to said second wall.

5. An arrangement as in claim 4, wherein said hook means comprise a generally U-shaped member opening towards said second end of said can and said hook engaging means comprises a plate extending from said second end of said can into said opening of said generally U-shaped member when said can is fastened between said U-shaped member and said second wall and against said first wall.

6. An arrangement as in claim 5, including conduit means from said solenoid operated valve means to an engine, said conduit means passing through said fire wall and said first wall.

* * * * *